US009254501B2

(12) United States Patent
Nabeshima et al.

(10) Patent No.: US 9,254,501 B2
(45) Date of Patent: Feb. 9, 2016

(54) METHOD OF SUPPLYING PAINT TO A PAINT CARTRIDGE

(75) Inventors: Atsuo Nabeshima, Okazaki (JP); Shinji Tani, Miyoshi (JP); Takanobu Mori, Toyota (JP); Isamu Yamasaki, Toyota (JP); Shinichi Nakane, Toyota (JP); Koji Fukuzawa, Toyota (JP); Tomohiro Hasuike, Toyota (JP)

(73) Assignees: TOYOTA JIDOSHA KABUSHIKI KAISHA, Toyota-Shi (JP); TRINITY INDUSTRIAL CORPORATION, Toyota-Shi (JP)

( * ) Notice: Subject to any disclaimer, the term of this patent is extended or adjusted under 35 U.S.C. 154(b) by 693 days.

(21) Appl. No.: 13/503,328

(22) PCT Filed: Oct. 19, 2010

(86) PCT No.: PCT/IB2010/002833

§ 371 (c)(1),
(2), (4) Date: Aug. 15, 2012

(87) PCT Pub. No.: WO2011/048489

PCT Pub. Date: Apr. 28, 2011

(65) Prior Publication Data

US 2012/0312414 A1 Dec. 13, 2012

(30) Foreign Application Priority Data

Oct. 21, 2009 (JP) ..... 2009-242833

(51) Int. Cl.
*B65B 3/04* (2006.01)
*B05B 12/14* (2006.01)

(52) U.S. Cl.
CPC ..... *B05B 12/1463* (2013.01)

(58) Field of Classification Search
CPC ..... B05B 12/1463
USPC ..... 141/1, 20.5, 85, 89, 90, 91, 92, 98, 104, 141/105, 192, 279, 284
See application file for complete search history.

(56) References Cited

U.S. PATENT DOCUMENTS 3,820,578 A * 6/1974 Staba ..... 141/190
3,981,320 A 9/1976 Wiggins (Continued)

FOREIGN PATENT DOCUMENTS

DE 4339302 A1 5/1995
DE 4342128 A1 6/1995

(Continued)

OTHER PUBLICATIONS

International Search Report and Written Opinion of PCT/IB2010/002833 mailed Mar. 24, 2011.

(Continued)

*Primary Examiner* — Kevin P Shaver
*Assistant Examiner* — Andrew Schmid
(74) *Attorney, Agent, or Firm* — Kenyon & Kenyon LLP

(57) ABSTRACT

A paint supply method supplies a paint into a paint cartridge by using a filling valve that has: a paint supply channel that is linkable in communication with a supply portion provided for supplying the paint into the paint cartridge; a branch channel that branches from the paint supply channel near a site of linkage in communication between the supply portion and the paint supply channel; and a trigger valve as an open-close valve of the paint supply channel which is disposed in the paint supply channel upstream of the site of linkage in communication. After a filling liquid is filled into the branch channel, the trigger valve (open-close valve) is opened, and the paint is supplied into the paint cartridge via the paint supply channel.

3 Claims, 4 Drawing Sheets

(56) References Cited

U.S. PATENT DOCUMENTS

| | | | | |
|---|---|---|---|---|
| 4,313,475 | A | 2/1982 | Wiggins | |
| 4,745,011 | A * | 5/1988 | Fukuta et al. | 427/426 |
| 4,792,092 | A | 12/1988 | Elberson et al. | |
| 4,884,752 | A | 12/1989 | Plummer | |
| 5,072,881 | A | 12/1991 | Taube | |
| 5,197,676 | A | 3/1993 | Konieczynski et al. | |
| 5,255,856 | A | 10/1993 | Ishibashi et al. | |
| 5,271,569 | A | 12/1993 | Konieczynski et al. | |
| 5,293,911 | A | 3/1994 | Adeel | |
| 5,309,959 | A * | 5/1994 | Shaw et al. | 141/130 |
| 5,676,756 | A * | 10/1997 | Murate et al. | 118/629 |
| 5,725,161 | A * | 3/1998 | Hartle | 239/690 |
| 5,788,164 | A * | 8/1998 | Tomita et al. | 239/700 |
| 6,010,084 | A * | 1/2000 | Yoshida et al. | 239/703 |
| 6,071,346 | A | 6/2000 | Yamauchi et al. | |
| 6,077,354 | A | 6/2000 | Kaneski et al. | |
| 6,164,561 | A * | 12/2000 | Yoshida et al. | 239/223 |
| 6,179,217 | B1 * | 1/2001 | Yoshida et al. | 239/7 |
| 6,253,800 | B1 | 7/2001 | Yoshida | |
| 6,391,392 | B1 | 5/2002 | Thome et al. | |
| 6,401,768 | B2 | 6/2002 | Lichte et al. | |
| 6,533,861 | B1 * | 3/2003 | Matsuda et al. | 118/323 |
| 6,582,774 | B2 | 6/2003 | Klein et al. | |
| 6,612,345 | B1 * | 9/2003 | Hosoda et al. | 141/20.5 |
| 6,630,025 | B2 | 10/2003 | Nonomura et al. | |
| 6,705,361 | B2 | 3/2004 | Niederquell et al. | |
| 6,742,722 | B2 * | 6/2004 | Hosoda et al. | 239/305 |
| 7,066,186 | B2 | 6/2006 | Bahr | |
| 7,549,449 | B2 | 6/2009 | Herre et al. | |
| 8,006,921 | B2 * | 8/2011 | Yamasaki et al. | 239/305 |
| 8,016,001 | B2 | 9/2011 | Yamasaki et al. | |
| 8,042,579 | B2 * | 10/2011 | Matsumoto | 141/94 |
| 8,146,840 | B2 | 4/2012 | Nakazono et al. | |
| 8,201,585 | B2 * | 6/2012 | Nomura et al. | 141/20.5 |
| 8,225,740 | B2 * | 7/2012 | Mitsui et al. | 118/323 |
| 2002/0043567 | A1 | 4/2002 | Provenaz et al. | |
| 2002/0046699 | A1 | 4/2002 | Congard et al. | |
| 2002/0081386 | A1 | 6/2002 | Yoshida et al. | |
| 2002/0158148 | A1 * | 10/2002 | Hosoda et al. | 239/305 |
| 2003/0234299 | A1 * | 12/2003 | Hosoda et al. | 239/302 |
| 2004/0020551 | A1 | 2/2004 | Cebola et al. | |
| 2005/0076832 | A1 | 4/2005 | Nakane | |
| 2005/0189435 | A1 * | 9/2005 | Kubota et al. | 239/223 |
| 2009/0108109 | A1 * | 4/2009 | Mori et al. | 239/694 |
| 2009/0206177 | A1 * | 8/2009 | Hamamura et al. | 239/328 |
| 2009/0277378 | A1 * | 11/2009 | Yamauchi | 118/300 |
| 2009/0277530 | A1 * | 11/2009 | Nomura et al. | 141/2 |
| 2010/0001099 | A1 * | 1/2010 | Onda | 239/302 |
| 2010/0243101 | A1 * | 9/2010 | Matsumoto | 141/27 |
| 2011/0020561 | A1 * | 1/2011 | Tani | 427/458 |
| 2012/0312414 | A1 * | 12/2012 | Nabeshima et al. | 141/2 |
| 2013/0167971 | A1 * | 7/2013 | Yamauchi | 141/1 |
| 2013/0320109 | A1 * | 12/2013 | Yamauchi | 239/112 |
| 2014/0151462 | A1 * | 6/2014 | Yamauchi | 239/112 |
| 2014/0166779 | A1 * | 6/2014 | Yamauchi | 239/263 |

FOREIGN PATENT DOCUMENTS

| | | | | |
|---|---|---|---|---|
| EP | 1095707 | A2 | 5/2001 | |
| EP | 1 566 221 | A2 | 8/2005 | |
| EP | 1897622 | A1 | 3/2008 | |
| EP | 2 095 879 | A1 | 9/2009 | |
| EP | 2095879 | A1 * | 9/2009 | B05B 12/14 |
| FR | 2719790 | A1 | 11/1995 | |
| JP | 61046278 | A | 3/1986 | |
| JP | 04200664 | A | 7/1992 | |
| JP | 09234397 | A | 9/1997 | |
| JP | 10151385 | A | 6/1998 | |
| JP | 2000-176328 | A | 6/2000 | |
| JP | 2000317360 | A | 11/2000 | |
| JP | 2001219110 | A | 8/2001 | |
| JP | 2002-011396 | A | 1/2002 | |
| JP | 2002-096002 | A | 4/2002 | |
| JP | 2003334484 | A | 11/2003 | |
| JP | 200769133 | A | 3/2007 | |
| JP | 2007055841 | A | 3/2007 | |
| JP | 200798389 | A | 4/2007 | |
| JP | 2008-212869 | A | 9/2008 | |
| JP | 2009-056382 | A | 3/2009 | |
| WO | 97/34707 | A1 | 9/1997 | |
| WO | 2006132305 | A1 | 12/2006 | |
| WO | 2008065794 | A1 | 6/2008 | |
| WO | 2011/048488 | A1 | 4/2011 | |
| WO | 2011048489 | A1 | 4/2011 | |

OTHER PUBLICATIONS

International Search Report and Written Opinion of PCT/1B2010/002828 mailed Mar. 28, 2011.

Extended EP Search Report mailed Jul. 7, 2011.

Office Action mailed May 24, 2011 in TW97133356 and partial translation thereof.

* cited by examiner

METHOD OF SUPPLYING PAINT TO A PAINT CARTRIDGE

This is a 371 national phase application of PCT/IB2010/002833 filed 19 Oct. 2010, claiming priority to Japanese Patent Application No. 2009-242833 filed 21 Oct. 2009, the contents of which are incorporated herein by reference.

BACKGROUND OF THE INVENTION

1. Field of Invention

The invention relates to a technology regarding a method of supplying paint into a paint cartridge. More concretely, the invention relates to a technology regarding a paint supply method that is able to economically and certainly reduce the paint loss in conjunction with a paint cartridge that is detachably attached to an electrostatic painting machine, without requiring the provision of a mechanical shutting-off mechanism or the like.

2. Description of Related Art

Generally, the painting of bodies of motor vehicles and the like, due to its requirement for high painting quality, employs electrostatic painting machines that are excellent in the efficiency of adhesion of paint to painting surfaces, the smoothness of paint films after the painting process, etc. A widely known example of the electrostatic painting machines is a rotary atomizing head type painting machine. The rotary atomizing head type painting machine is equipped with a rotary atomizing head for atomizing a water base paint, a plurality of paint cartridges that are filled with paints of different colors, etc. To perform painting of an object to be painted, a paint cartridge filled with a paint of a designated color is selected. Then, the paint filled in the paint cartridge is jetted out via rotary atomizing heads, so that paint particles are atomized, and accomplish the painting. When the paint in the paint cartridge runs out, the paint cartridge is attached to a paint filling apparatus (paint supply apparatus), and is thereby supplied with the paint again. Thus, the rotary atomizing head type painting machine becomes able to carry out the painting again.

As for the paint supply apparatus for supplying paint into a paint cartridge that has become empty, various constructions have been proposed. A known example thereof is a paint supply apparatus that is equipped with a filling valve.

With reference to FIGS. 4A and 4B, a general construction of a filling valve 1 will be described. Inside the filling valve 1, there are provided a paint supply channel 3 that is detachably linked in communication with a supply portion 11 that leads to the inside of a paint cartridge 10, a trigger valve 9 that functions as an open-close valve of the paint supply channel 3 at the site of linkage in communication between the paint supply channel 3 and the supply portion 11, etc. In the vicinity of the trigger valve 9, a cleaning liquid supply channel 7 and a waste liquid discharge channel 8 are linked in communication with the paint supply channel 3. Via the cleaning liquid supply channel 7, a cleaning liquid for cleaning the site of linkage in communication between the supply portion 11 and the paint supply channel 3 as well as compressed air and the like are supplied to the vicinity of the site of linkage. Besides, the waste liquid having been used to clean the vicinity of the linkage site is discharged to the outside of the filling valve 1 via the waste liquid discharge channel 8.

In a paint supply method for the paint cartridge 10 of a comparative example which uses the foregoing filling valve 1, when paint is to be supplied from the filling valve 1 into the paint cartridge 10, the trigger valve 9 is moved (in the direction of an arrow Q1 shown in FIG. 4A) to change the paint supply channel 3 into an "open" state. Then, the paint supply channel 3 becomes linked in communication with the cleaning liquid supply channel 7 and the waste liquid discharge channel 8 as well as with the supply portion 11. As a result, as shown in FIG. 4B, a part of paint 51 that flows inside the paint supply channel 3 flows out into the cleaning liquid supply channel 7 and the waste liquid discharge channel 8, so that the part of the paint 51 compresses the air remaining in the two channels 7 and 8, and thus fills substantially the entire spaces in the two channels 7 and 8. The paint 51 filling the cleaning liquid supply channel 7 and the waste liquid discharge channel 8 is washed off by the cleaning liquid and is discharged to the outside of the filling valve 1 at the time of changing the paint color that is supplied through the filling valve 1. The thus-discharged amount of the paint 51 is not fed back into the paint cartridge 10, but is discarded as a paint loss.

In order to minimize the paint loss that occurs, at the time of supplying paint into a paint cartridge, there have been proposed technologies as shown in Japanese Patent Application Publication No. 2000-176328 (JP-A-2000-176328), Japanese Patent Application Publication No. 2008-212869 (JP-A-2008-212869), and Japanese Patent Application Publication No. 2009-56382 (JP-A-2009-56382).

That is, Japanese Patent Application Publication No. 2000-176328 (JP-A-2000-176328) proposes a paint filling apparatus that fills a paint into a paint cartridge that is constructed of a cylinder that is to be filled with the paint and a feed tube that extends in the direction of a center axis of the cylinder. Specifically, the disclosed technology relates to an apparatus for filling a paint into a cartridge which has: a feed tube insert hole to insert the feed tube through is provided extending in the direction of an axis of the feed tube; a filling table having a cylinder support portion that is formed by a distal end opening side portion of the feed tube insert hole portion so as to support the cylinder; a connection member that is provided on the filling table at a location that is closer to the inside of the cylinder than the feed tube insert hole so as to connect a distal end of the feed tube to a paint channel that leads to a paint supply source; and a filling valve that is provided in the paint channel so as to carry out the supply of paint into the cartridge via the connection member and the stop of the supply.

Inside the filling valve, there are formed a paint supply passageway (paint supply channel) that connects to the paint supply source, and a drain passageway (waste liquid discharge channel) that connects to a drain tank. These two passageways are interlinked in communication via a linking passageway. When a paint is to be supplied into the paint cartridge, the drain passageway is shut off (closed) by a residual pressure relief valve that is provided in an intermediate portion of the drain passageway, so as to prevent part of the paint from flowing into the drain passageway (waste liquid discharge channel).

Japanese Patent Application Publication No. 2008-212869 (JP-A-2008-212869) proposes a paint filling apparatus (paint supply apparatus) that includes: a paint manifold having a plurality of collar valves; a cartridge attachment portion to which a paint cartridge is detachably attached; a paint filling channel (paint supply channel) that leads paint from the paint manifold into the paint cartridge when the paint cartridge is attached to the cartridge attachment portion; and a discharge channel (usage liquid discharge channel) that discharges paint and air residing in the paint filling channel to the outside. In the disclosed technology, a throttle device that has a plurality of elements that are disposed in line on the discharge channel is provided on the discharge channel (waste liquid discharge channel).

Japanese Patent Application Publication No. 2009-56382 (JP-A-2009-56382) discloses a technology relating to a paint filling apparatus (paint supply apparatus) that includes: a paint cartridge attachment portion that a paint cartridge is attachable to and detachable from; a paint supply channel that connects to the paint cartridge attached to the cartridge attachment portion; a first switching device (trigger valve) that switches between the linkage in communication between the paint supply channel and the paint cartridge attached to the cartridge attachment portion and the discontinuation of the linkage; a paint supply device that sends paint out into the paint supply channel; a discharge channel (waste liquid discharge channel) linked in communication with the paint supply channel; a second switching device that switches between a fully open state and a fully closed state of the discharge channel (waste liquid discharge channel); a paint sensor that detects paint in the discharge channel (waste liquid discharge channel); and a control device that is connected to the paint sensor and the second switching device, and that causes the discharge channel to assume the fully closed state by using the second switching device when the paint sensor detects the paint.

According to the technologies disclosed in Japanese Patent Application Publication No. 2000-176328 (JP-A-2000-176328), Japanese Patent Application Publication No. 2008-212869 (JP-A-2008-212869), and Japanese Patent Application Publication No. 2009-56382 (JP-A-2009-56382), the paint loss that occurs at the time of supplying paint into the paint cartridge can be minimized. However, in the technology disclosed in Japanese Patent Application Publication No. 2000-176328 (JP-A-2000-176328), the force that holds the residual pressure relief valve in the valve closure direction is composed of the urging force that is given by urging means, such as a coil spring provided within the filling valve, or the like, so that a part of the paint may sometimes flow into the drain passageway depending on increase in the back pressure that occurs in the paint supply channel. Thus, it is difficult to completely prevent the paint loss. Besides, neither Japanese Patent Application Publication No. 2008-212869 (JP-A-2008-212869) nor Japanese Patent Application Publication No. 2009-56382 (JP-A-2009-56382) shows a technology for preventing paint from flowing out into the waste liquid discharge channel linked in communication with the paint supply channel. Thus, a fundamental measure for reducing the paint loss has not been found.

SUMMARY OF THE INVENTION

The invention, relating to a paint cartridge that is detachably attached to an electrostatic painting machine as mentioned above, provides a technology that economically and certainly reduces the paint loss that occurs at the time of supplying paint into the paint cartridge without requiring the provision of a mechanical shutting-off mechanism or the like.

An aspect of the invention relates to a paint supply method of supplying a paint into a paint cartridge by using a filling valve that has: a paint supply channel that is linkable in communication with a supply portion provided for supplying the paint into the paint cartridge; a branch channel that branches from the paint supply channel near a site of linkage in communication between the supply portion and the paint supply channel; and an open-close valve of the paint supply channel which is disposed in the paint supply channel upstream of the site of linkage in communication. In this method, after a filling liquid is filled into the branch channel, the open-close valve is opened, and the paint is supplied into the paint cartridge via the paint supply channel.

The branch channel may be constructed of a cleaning liquid supply channel that supplies a cleaning liquid for cleaning the site of linkage in communication and supplies a compressed air for discharging a post-cleaning waste liquid, and a waste liquid discharge channel that discharges the post-cleaning waste liquid from the site of linkage in communication and discharges the compressed air to an outside of the branch channel, and the filling liquid may be supplied via the cleaning liquid supply channel.

The cleaning liquid supply channel and the waste liquid discharge channel may be provided with open-close valves that open and close an intermediate portion of the cleaning liquid supply channel and an intermediate portion of the waste liquid discharge channel, respectively, and after the cleaning liquid supply channel and the waste liquid discharge channel are filled with the filling liquid, the open-close valves may be closed to confine the filling liquid within the cleaning liquid supply channel and the waste liquid discharge channel, and after the filling liquid is confined, the paint may be supplied into the paint cartridge via the paint supply channel.

The filling liquid may be pure water.

According to the paint supply method of the invention, in conjunction with a paint cartridge that is detachably attached to an electrostatic painting machine, it is possible to economically and certainly reduce the paint loss that occurs when paint is supplied into the paint cartridge, without requiring the provision of a mechanical shutting-off mechanism or the like.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein:

FIG. 3A is a sectional view showing a state that immediately follows the attachment of the paint cartridge to the filling valve, and FIG. 3B is a sectional view showing a state in which a filling liquid is caused to flow into a cleaning liquid channel provided in the filling valve, and FIG. 3C is a sectional view showing a state in which a paint is caused to flow into a paint channel provided in the filling valve; FIG. 4A is a sectional view showing a state that immediately follows the attachment of the paint cartridge to the filling valve, and FIG. 4B is a sectional view showing a state in which a paint is caused to flow into a paint channel provided in the filling valve.

DETAILED DESCRIPTION OF EMBODIMENTS

[Construction of Filling Valve 1]

Figure 1:
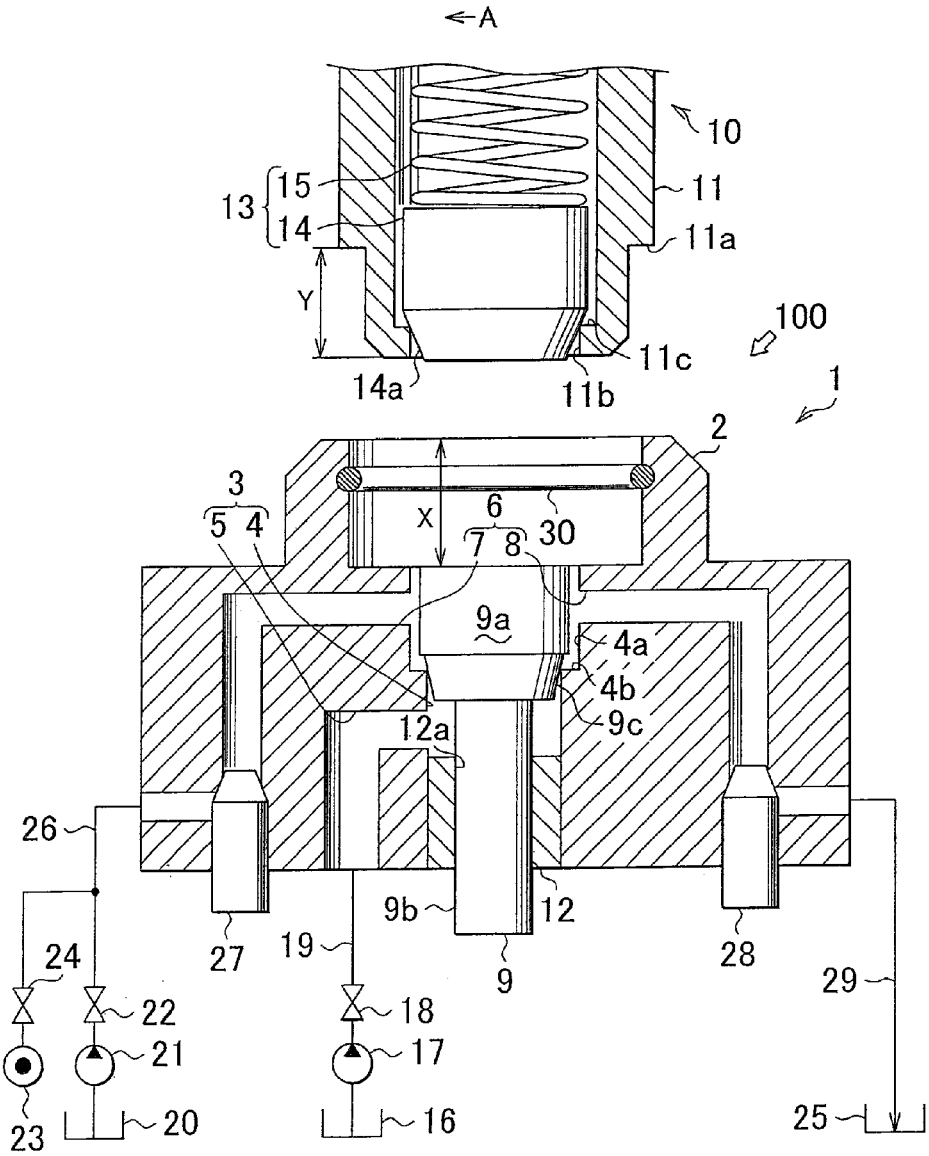
FIG. 1 is a sectional view showing an overall construction of a paint supply system in accordance with an embodiment of the invention.
Figure 2:
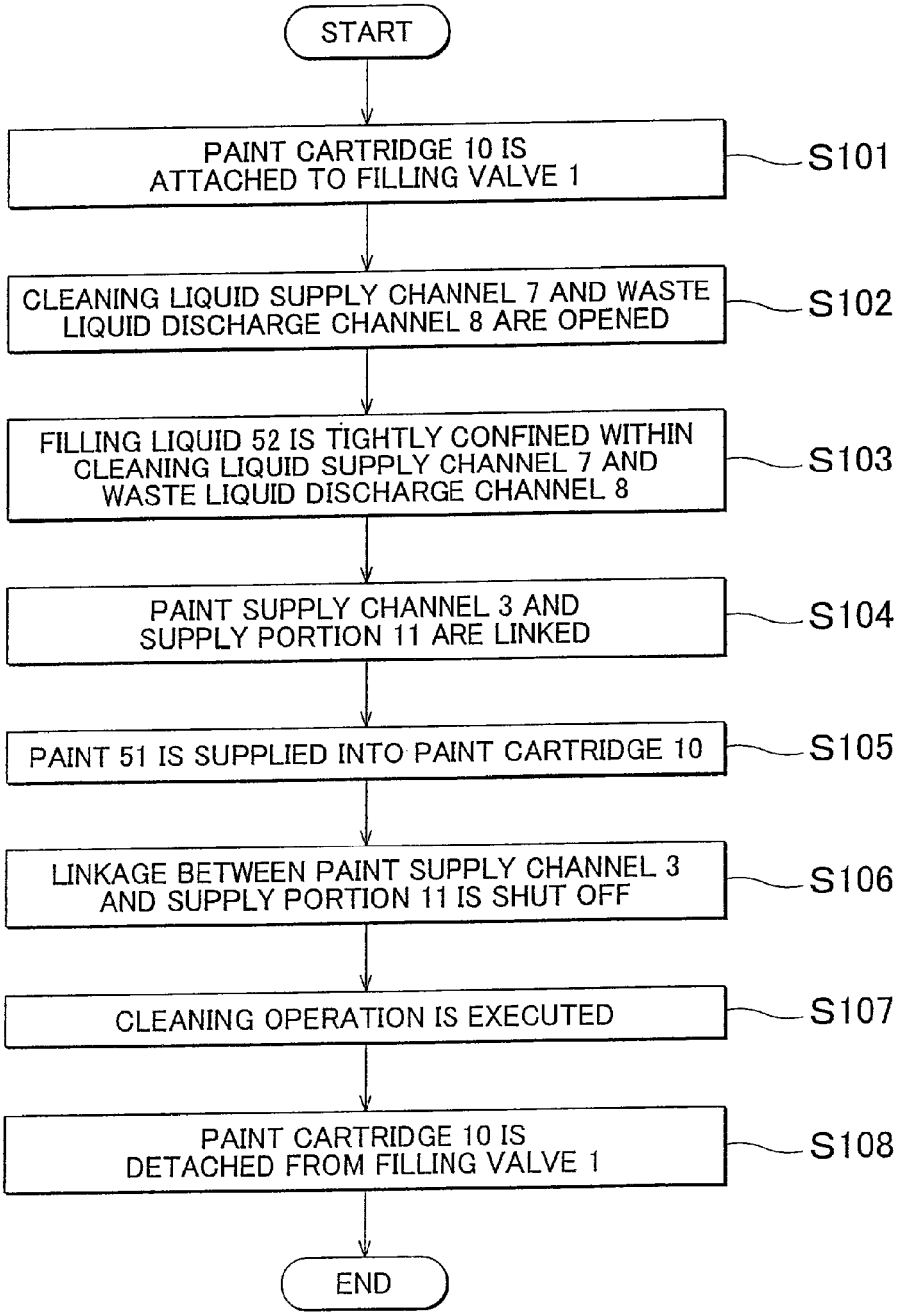
FIG. 2 is a flowchart showing a flow of operation that a filling valve performs when filling a paint into a paint cartridge.

Firstly, a construction of a filling valve 1 that is used to embody a paint supply method in accordance with the invention will be described with reference to FIG. 1. For the sake of convenience in description, the up-down or vertical directions in FIG. 1 are defined as the up-down or vertical directions with respect to the filling valve 1, and the direction of an arrow A in FIG. 1 is defined as the forward direction with respect to the filling valve 1.

The filling valve 1 is disposed in a paint supply apparatus 100 that supplies paint into a paint cartridge 10, and is provided as a valve mechanism for filling an appropriate amount of paint into the paint cartridge 10. A central portion of an upper surface of the filling valve 1 is provided with a support portion 2 that detachably supports the paint cartridge 10. An inside of the filling valve 1 is provided with a paint supply channel 3 that is linked in communication with the support portion 2, a branch channel 6 that branches from the paint supply channel 3, etc.

Firstly, the support portion 2 will be described. The support portion 2 is formed as a cylindrical protrusion that is protruded upward. A packing member 30, such as an O-ring or the like, is fixed to an inner peripheral portion of the support portion 2.

A lower portion of the paint cartridge 10 is provided with a cylindrically shaped supply portion 11 that extends downward. An inside diameter portion of the supply portion 11 is linked in communication with an inside of the paint cartridge 10. Besides, a lower end portion of an outer diameter portion of the supply portion 11 has a rather smaller diameter than a rest of the outer diameter portion. A step portion 11*a* is formed at a boundary between the smaller-diameter lower end portion and the rest of the outer diameter portion of the supply portion 11. The supply portion 11 is constructed as a supply opening portion for supplying paint from the filling valve 1 into the paint cartridge 10.

In a plan view, the cross-sectional shape of an inside diameter portion of the support portion 2 is rather larger than the cross-sectional shape of the outside diameter portion of the lower end portion of the supply portion 11. In a side view, a height measurement of the inside diameter portion of the support portion 2 (a measurement X in FIG. 1) is rather larger than a length measurement from a lower end surface of the supply portion 11 to the step portion 11*a* (a measurement Y in FIG. 1).

The paint cartridge 2 is attached to the filling valve 1 by inserting the outside diameter portion of the lower end portion of the supply portion of the paint cartridge 10 into the inside diameter portion of the support portion 2 in the direction from above to below. The position of the supply portion 11 in the downward direction is restricted by the step portion 11*a* of the supply portion 11 contacting the upper end surface of the support portion 2 of the filling valve 1 before the lower end surface of the supply portion 11 contacts a lower surface of the inside diameter portion of the support portion 2. That is, when the supply portion 11 of the paint cartridge 10 has been attached to the inside diameter portion of the support portion 2, a certain amount of space 2*a* (see FIG. 3A) is formed between the bottom surface of the inside diameter portion of the support portion 2 and the lower end portion of the supply portion 11.

Incidentally, when the attachment of the paint cartridge 10 to the filling valve 1 is completed, the gap between an outer peripheral surface of the lower end portion of the supply portion 11 and an inner peripheral surface of the support portion 2 is closed by the packing member 30. As a result, the supply portion 11 and the inside diameter portion of the support portion 2 are completely sealed from the atmosphere outside the filing valve 1.

Next, the paint supply channel 3 will be described. The paint supply channel 3 is formed within the filling valve 1 as a channel for supplying paint into the paint cartridge 10. The paint supply channel 3 is constructed of a first supply channel 4 that is linked in communication with the support portion 2, and a second supply channel 5 that connects to the paint tank 16, which is a paint supply source.

The first supply channel 4 is provided in a central portion of the support portion 2 in a plan view, and penetrates the filling valve 1 in the up-down direction. That is, the first supply channel 4 is formed coaxially with the support portion 2, and has a circular cross-sectional shape in a plan view. An upper end portion of the first supply channel 4 is linked in communication with the inside diameter portion of the support portion 2. Incidentally, a portion of the first supply channel that extends from a substantially central portion to an upper end portion thereof in the up-down direction is formed as an increased-diameter portion 4*a* that is larger in diameter than a rest of the first supply channel 4 (a portion of the first supply channel 4 that extends from the substantially central portion to a lower end portion thereof in the up-down direction). Besides, a step portion 4*b* is formed at a lower end of the increased-diameter portion 4*a*.

The second supply channel 5 is formed near the first supply channel 4, and is linked to a portion of the first supply channel 4 that is below the increased-diameter portion 4*a* so that the first and second supply channels 4 and 5 communicate with each other. That is, the second supply channel 5 extends upward from a lower surface of the filling valve 1, near the first supply channel 4. At an end of the upward extension, the second supply channel 5 bends toward the first supply channel 4, and is linked to the first supply channel 4 so that the second supply channel 5 and the first supply channel 4 communicate with each other.

A bearing member 12 is fitted into a lower portion of the first supply channel 4 that is below the site of linkage in communication with the second supply channel 5. The bearing member 12 has a penetration hole 12*a* that vertically penetrates a central portion of the bearing member 12 in a plan view. A trigger valve 9 described below is inserted in the penetration hole 12*a* so as to be slidable up and down.

A piping member 19 is connected to a lower end portion of the second supply channel 5. An end portion of the piping member 19 connects to a paint tank 16, and another end portion thereof is linked in communication with the second supply channel 5. Besides, an intermediate portion of the piping member 19 is provided with a paint pump 17 and a paint valve 18.

Then, when the paint valve 18 assumes an "open" state, the paint discharged from the paint tank 16 by the paint pump 17 is supplied into the second supply channel 5 via the piping member 19.

Thus, in the paint supply channel 3 made up of the first supply channel 4 and the second supply channel 5, the upper end portion of the first supply channel 4 (the upper end portion of the increased-diameter portion 4*a*) is linked in communication with the support portion 2 to which the supply portion 11 of the paint cartridge 10 is detachably attached, and a lower end portion of the second supply channel 5 connects to the paint tank 16, which is a paint supply source.

That is, the paint supply channel 3 is constructed so as to be capable of being linked in communication with the supply portion 11. The paint in the paint tank 16 is supplied into the support portion 2 through the paint supply channel 3, and is then supplied into the supply portion 11 of the paint cartridge 10 via the support portion 2.

Incidentally, a valve body portion 9*a* of the trigger valve 9 is housed within an upper portion of the first supply channel 4. Thus, the trigger valve 9 controls the open-closed state of the paint supply channel 3.

That is, for example, when the paint cartridge 10 is not attached to the filling valve 1, it is necessary to close an outlet opening portion of the paint supply channel 3 (i.e., a site of linkage in communication between the paint supply channel 3 and the support portion 2 and, more specifically, an inside diameter portion of the step portion 4*b* at a bottom surface of the increased-diameter portion 4*a*) so as to prevent the paint from being supplied to the support portion 2. On the other hand, when the paint cartridge 10 is attached to the filling valve 1, it is necessary to open the outlet opening portion of the paint supply channel 3 so as to allow the paint to be supplied to the support portion 2.

The opening-closing control of the outlet opening portion of the paint supply channel 3 in conjunction with the supply of the paint to the support portion 2 as described above is performed by the trigger valve 9. That is, the trigger valve 9 as an open-close valve of the paint supply channel 3 is provided at a site of linkage in communication between the paint supply channel 3 and the supply portion 11, and the open-closed state of the paint supply channel 3 is controlled by the trigger valve 9. Specifically, the trigger valve 9 is disposed upstream of the site of linkage in communication of the paint supply channel 3 with respect to the supply portion 11. Incidentally, in the paint supply channel 3, a side thereof that connects to the paint tank 16 is an upstream side in terms of the flow of paint, and a side that is linked in communication with the support portion 2 is a downstream side in terms of the flow of paint.

Details of the trigger valve 9 will be described. The trigger valve 9 is constructed of the valve body portion 9*a* and a guide portion 9*b*. The valve body portion 9*a* is made of a cylindrical solid member, with its center axis lying in the up-down direction and coinciding the axis of the first supply channel 4 of the paint supply channel 3.

In a plan view, a cross-sectional shape of the valve body portion 9*a* is smaller than the cross-sectional shape of the increased-diameter portion 4*a* that is an upper portion of the first supply channel 4, and is larger than the cross-sectional shape of a lower portion the first supply channel 4. Besides, a lower portion of the valve body portion 9*a* has a taper portion 9*c* whose diameter gradually decreases toward a lower side. A cross-sectional shape of a lower end surface of the taper portion 9*c* is smaller than a cross-sectional shape of a lower portion of the first supply channel 4.

On the other hand, the guide portion 9 is made of a round bar member, and is firmly provided on a lower surface of the valve body portion 9*a* so as to be coaxial with the valve body portion 9*a* and extend downward. Besides, in a plan view, a cross-sectional shape of the guide portion 9*b* is substantially the same as a cross-sectional shape of the penetration hole 12*a* of the bearing member 12 that is fitted in a lower portion of the first supply channel 4.

As the trigger valve 9 constructed as described above is inserted into the first supply channel 4 from above to below, the guide portion 9*b* is firstly inserted into the penetration hole 12*a* of the bearing member 12, and subsequently the taper portion 9*c* of the valve body portion 9*a* is fitted into the step portion 4*b* of the increased-diameter portion 4*a*. That is, in the increased-diameter portion 4*a*, which is a site of linkage in communication between the paint supply channel 3 and the branch channels 6 (the cleaning liquid supply channel 7 and the waste liquid discharge channel 8), the trigger valve 9 as an open-close valve is disposed at the step portion 4*b* at the bottom portion of the increased-diameter portion 4*a*.

Since the taper portion 9*c* of the valve body portion 9*a* contacts the step portion 4*b* of the increased-diameter portion 4*a*, the trigger valve 9 is restricted from moving any further downward and the outlet opening portion of the paint supply channel 3 is closed by the body portion 9*a* of the trigger valve 9.

In order to open the outlet opening portion of the paint supply channel 3, it suffices to move the trigger valve 9 upward from a state in which the taper portion 9*c* of the valve body portion 9*a* of the trigger valve 9 is in contact with the step portion 4*b* of the increased-diameter portion 4*a*. During this time, the guide portion 9*b* slides within the penetration hole 12*a* of the bearing member 12, which restricts the trigger valve 9 from deflecting horizontally.

The supply portion 11 of the paint cartridge 10 is provided with an open-close valve 13 that opens and closes in coordination with the up-down movements of the trigger valve 9 while the supply portion 11 is attached to the support portion 2 of the filling valve 1. The open-close valve 13 is constructed mainly of a valve body 14, urging means 15, etc.

The valve body 14 is made of a cylindrical solid member, and is disposed within a lower end portion of the supply portion 11, with its center axis lying in the up-down direction and coinciding with the axis of the supply portion 11. Besides, a lower portion of the valve body 14 is provided with a taper portion 14*a* whose diameter gradually decreases toward below.

A penetration hole 11*b* is provided in the lower end surface of the supply portion 11. In a plan view, a cross-sectional shape of the penetration hole 11*b* is slightly smaller than a cross-sectional shape of an inside-diameter portion of the supply portion 11. Therefore, a step portion 11*c* is formed at a lower end of the inside diameter portion of the supply portion 11.

A cross-sectional shape of the valve body 14 in a plan view is smaller than a cross-sectional shape of the inside of the supply portion 11 in a plan view, and is larger than a cross-sectional shape of the penetration hole 11*b* in a plan view. Besides, a cross-sectional shape of a lower end surface of the taper portion 14*a* in a plan view is smaller than the cross-sectional shape of the penetration hole 11*b* in a plan view.

The valve body 14 shaped as described is inserted into the inside diameter portion of the supply portion 11, and the urging means 15 is disposed on an upper end portion of the valve body 14 so as to be coaxially with the valve body 14. In this manner, the open-close valve 13 of the supply portion 11 is constructed.

That is, the valve body 14 is always urged downward by the urging means 15, so that the taper portion 14*a* of the valve body 14 normally contacts the step portion 11*c* of the supply portion 11. Thus, the valve body 14 normally closes the penetration hole 11*b* that is formed in the lower end surface of the supply portion 11.

Besides, the supply portion 11 is inserted in the support portion 2 of the filling valve 1 when the paint cartridge 10 is attached to the filling valve 1. During this state, when the trigger valve 9 is slid upward, the upper end surface of the valve body portion 9*a* of the trigger valve 9 contacts the lower end surface of the valve body 14.

Figure 3A:
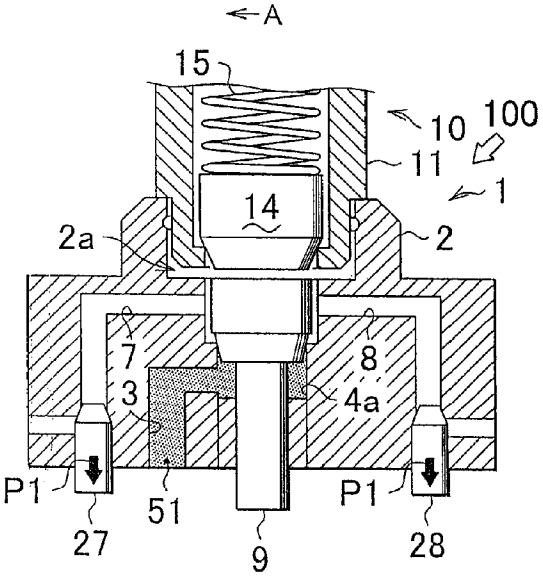
FIGS. 3A to 3C show the operation that the filling valve performs when filling a paint into a paint cartridge, and, specifically.
Figure 3B:
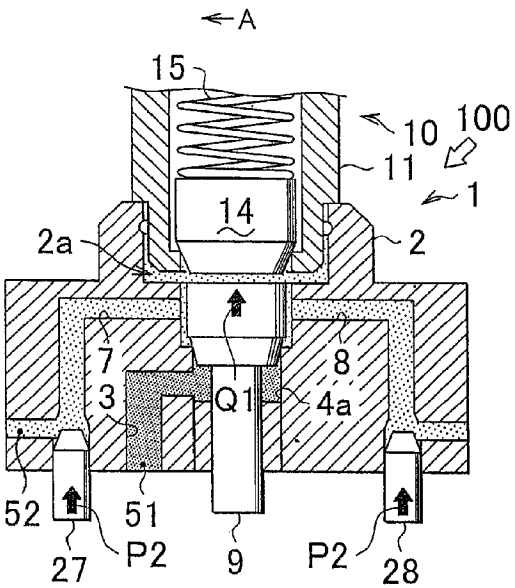
Figure 3C:
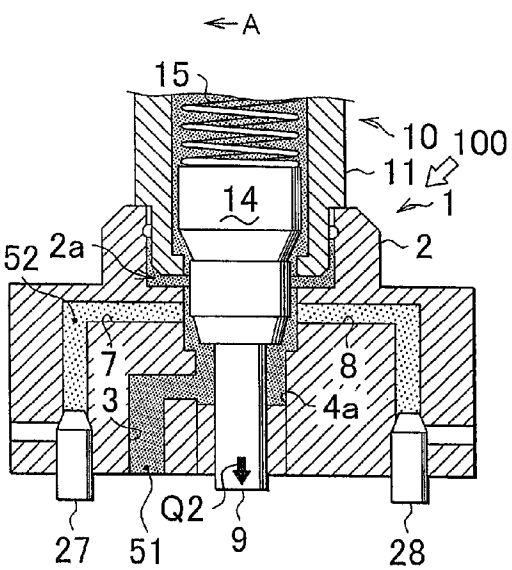

Then, as the trigger valve 9 is slid further upward, the valve body 14 is moved upward overcoming the downward force of the urging means 15, so that the penetration hole 11*b* formed in the lower end surface of the supply portion 11 is opened (see FIG. 3C).

Thus, due to the sliding movements of the trigger valve 9 in the up-down directions, the open-closed state of the site of linkage in communication between the paint supply channel 3 and the supply portion 11 is controlled so that an appropriate amount of paint can be supplied into the paint cartridge 10 via the paint supply channel 3. That is, due to the provision of the trigger valve 9, the filling valve 1 performs a function as a valve mechanism for filling an appropriate amount of paint into the paint cartridge 10.

Next, the branch channel 6 will be described. After the supply of paint into the paint cartridge 10 is completed, the branch channel 6 is used to supply a cleaning liquid, compressed air and the like for cleaning off the paint adhering to the site of linkage in communication between the filling valve 1 and the paint cartridge 10, and to discharge the post-cleaning waste liquid and the like to the outside of the filling valve 1. The branch channel 6 is constructed of: a cleaning liquid tank 20 that is a supply source of the cleaning liquid; a cleaning liquid supply channel 7 that connects to an air source 23 that is a supply source of compressed air, and the like; and a waste liquid discharge channel 8 that connects to a waste liquid tank 25 and the like.

The cleaning liquid supply channel 7 is formed in a crank shape, and is linked in communication with the first supply channel 4 of the paint supply channel 3. That is, the cleaning liquid supply channel 7 extends horizontally rearward from a front lower portion of the filling valve 1, and, from an end of the horizontal extension, extends vertically upward. Then, the cleaning liquid supply channel 7 extends horizontally rearward again to link in communication with a side surface of the increased-diameter portion 4*a* of the first supply channel 4.

An intermediate portion of the cleaning liquid supply channel 7 is provided with a cleaning valve 27 as an open-close valve within the cleaning liquid supply channel 7. The cleaning valve 27 is made up of a pin-shaped member. As the cleaning valve 27 slides in the direction of its axis, a distal end portion of the cleaning valve 27 closes the intermediate portion of the cleaning liquid supply channel 7.

A piping member 26 is connected to a front end portion of the cleaning liquid supply channel 7. An end portion of the piping member 26 is linked in communication with the cleaning liquid supply channel 7, and another end portion thereof is divided into two lines that connect to the cleaning liquid tank 20 and the air source 23, respectively. Besides, intermediate portions of the two branch lines of the piping member 26 are provided with a cleaning liquid pump 21 and a cleaning liquid valve 22 near the cleaning liquid tank 20, and with an air valve 24 near the air source 23.

When the air valve 24 assumes a "closed" state and the cleaning liquid valve 22 assumes an "open" state, the cleaning liquid discharged from the cleaning liquid tank 20 via the cleaning liquid pump 21 is led into the cleaning liquid supply channel 7 via the piping member 26, and is supplied into the increased-diameter portion 4*a* of the first supply channel 4. Besides, when the cleaning liquid valve 22 assumes a "closed" state and the air valve 24 assumes an "open" state, the compressed air supplied from the air source 23 is led into the cleaning liquid supply channel 7 via the piping member 26, and is pressure-fed into the increased-diameter portion 4*a* of the first supply channel 4.

The waste liquid discharge channel 8 is provided at an opposite side of the first supply channel 4 to the cleaning liquid supply channel 7. The waste liquid discharge channel 8 is formed in a crank shape, and is linked in communication with the first supply channel 4 of the paint supply channel 3. That is, the waste liquid discharge channel 8 extends horizontally forward from a rear lower portion of the filling valve 1 and, from an end of the horizontal extension, extends vertically upward. Then, the waste liquid discharge channel 8 extends horizontally forward again to link in communication with a side surface of the increased-diameter portion 4*a* of the first supply channel 4.

An intermediate portion of the waste liquid discharge channel 8 is provided with a waste liquid valve 28 as an open-close valve within the waste liquid discharge channel 8. The waste liquid valve 28 is made up of a pin-shaped member. As the waste liquid valve 28 slides in the direction of its axis, a distal end portion of the waste liquid valve 28 closes the intermediate portion of the waste liquid discharge channel 8.

Incidentally, although in this embodiment, the locations where the cleaning valve 27 and the waste liquid valve 28 are disposed are the end of the horizontal extension of the cleaning liquid supply channel 7 from the front lower portion of the filling valve 1 and the end of the horizontal extension of the waste liquid discharge channel 8 from the rear lower portion of the filling valve 1, respectively, these locations are not restrictive.

That is, the cleaning valve 27 and the waste liquid valve 28 may be disposed at any location as long as the location is in an intermediate portion of the cleaning liquid supply channel 7 or the waste liquid discharge channel 8. However, considering reduction of the amount of the filling liquid to be filled in, it is preferable that the cleaning valve 27 and the waste liquid valve 28 be provided near the increased-diameter portion 4*a* of the first supply channel 4.

Besides, the structure of the cleaning valve 27 and the waste liquid valve 28 is not limited to what is described above in conjunction with the embodiment. For example, each of the two valves may also be a butterfly type valve in which a platy member forming the same shape as the cross-section of the cleaning liquid supply channel 7 or the waste liquid discharge channel 8 is pivotably provided in the inside diameter portion of the cleaning liquid supply channel 7 or the waste liquid discharge channel 8.

A piping member 29 is connected to a rear end portion of the waste liquid discharge channel 8. An end portion of the piping member 29 connects to the waste liquid tank 25, and another end portion thereof is linked in communication with the waste liquid discharge channel 8.

The cleaning liquid supplied into the increased-diameter portion 4*a* of the first supply channel 4 via the cleaning liquid supply channel 7 washes off the paint adhering to the site of linkage in communication between the filling valve 1 and the paint cartridge 10, and is led as a waste liquid into the waste liquid discharge channel 8, and is then discharged into the waste liquid tank 25 via the piping member 29.

Thus, the cleaning liquid supply channel 7 and the waste liquid discharge channel 8 that constitute the branch channel 6 are linked in communication with the increased-diameter portion 4*a* of the paint supply channel 3, which in turn is linked in communication with the supply portion 11 of the paint cartridge 10. In other words, the branch channel 6 branches from the paint supply channel 3 in the vicinity of the site of linkage in communication between the paint supply channel 3 and the supply portion 11 of the paint cartridge 10.

Thus, the filling valve 1 has therein the above-described channels (i.e., the paint supply channel 3, the cleaning liquid supply channel 7, the waste liquid discharge channel 8, etc.), the valves (i.e., the trigger valve 9, the cleaning valve 27, the waste liquid valve 28, etc.), etc. The filling valve 1, the piping system that includes the foregoing various supply sources (i.e., the cleaning liquid tank 20, the air source 23, the paint tank 16, the waste liquid tank 25, etc.), etc. constitute the paint supply apparatus 100.

Incidentally, the cleaning liquid supply channel 7 and the waste liquid discharge channel 8 that constitute the branch channel 6 are not limited to the channels shaped as described above in conjunction with the embodiment. (i.e., the crank-shaped channels). That is, each of the cleaning liquid supply channel 7 and the waste liquid discharge channel 8 may have any shape as long as an end portion of the channel is linked in communication with the increased-diameter portion 4*a* of the paint supply channel 3 and another end portion thereof has an opening to the outside of the filling valve 1.

[Operations of Filling Valve 1]

Next, operations of the filling valve 1 performed to fill paint into the paint cartridge 10 will be described with reference to FIG. 2 and FIGS. 3A to 3C. Incidentally, for the sake of convenience in description, the up-down directions in FIGS. 3A to 3C are defined as the up-down directions of the filling valve 1, and the direction of an arrow A in FIGS. 3A to 3C is defined as the forward direction of the filling valve 1.

Firstly, a paint cartridge 10 that has become empty is set on the paint supply apparatus 100. Specifically, the supply portion 11 of the paint cartridge 10 is inserted into the inside diameter portion of the support portion 2 of the filling valve 1, so that the paint cartridge 10 is attached to the filling valve 1 (step S101).

At this time point, as shown in FIG. 3A, the trigger valve 9 has been moved to the lowermost position (i.e., a state in which the taper portion 9*c* of the valve body portion 9*a* is in contact with the step portion 4*b* of the increased-diameter portion 4*a*, as shown in FIG. 1), and therefore the outlet opening portion of the paint supply channel 3 is closed. Besides, the cleaning valve 27 disposed in the cleaning liquid supply channel 7 and the waste liquid valve 28 disposed in the waste liquid discharge channel 8 have also been moved to such positions as to close the two channels 7 and 8, respectively. Incidentally, the inside of the paint supply channel 3 is filled by the paint 51 to the outlet portion that is closed by the trigger valve 9.

After the paint cartridge 10 has been attached to the filling valve 1, the cleaning valve 27 and the waste liquid valve 28 are moved (in the direction shown by arrows P1 in FIG. 3A), so that the cleaning liquid supply channel 7 and the waste liquid discharge channel 8 having been closed by the cleaning valve 27 and the waste liquid valve 28, respectively, are opened (step S102).

Then, the filling liquid 52 is supplied from a front end portion of the cleaning liquid supply channel 7 (an upstream-side end portion thereof that communicates with the outside of the filling valve 1). After reaching the increased-diameter portion 4*a* of the paint supply channel 3, the filling liquid 52 is further sent into the waste liquid discharge channel 8, and then is discharged to the outside of the filling valve 1.

It is to be noted herein that as shown in FIG. 3B, the filling liquid 52 supplied via the cleaning liquid supply channel 7 sufficiently spreads in not only the cleaning liquid supply channel 7 and the increased-diameter portion 4*a* of the paint supply channel 3 but also the space 2*a* that is formed between the lower end surface of the supply portion 11 of the paint cartridge 10 and the bottom surface of the inside diameter portion of the support portion 2.

By causing the filling liquid 52 to fill the space 2*a* as well as the cleaning liquid supply channel 7, the increased-diameter portion 4*a* of the paint supply channel 3 and the waste liquid discharge channel 8 as described above, it is possible to completely remove the air remaining in the channels in the filling valve 1 and the space formed at the connecting site between the filling valve 1 and the paint cartridge 10.

The filling liquid 52 is a liquid, and therefore is non-compressible. Therefore, once the filling liquid 52 is filled into the cleaning liquid supply channel 7 and the waste liquid discharge channel 8, the paint 51 will not flow into the channels 7 and 8 by forcing the filling liquid 52 away. Thus, it is possible to certainly reduce the paint loss that occurs when the paint 51 is supplied into the paint cartridge 10.

After the filling liquid 52 spreads sufficiently in the cleaning liquid supply channel 7, the increased-diameter portion 4*a* of the paint supply channel 3 and the waste liquid discharge channel 8, the cleaning valve 27 and the waste liquid valve 28 are moved (in the direction shown by arrows P2 in FIG. 3B) so that the cleaning liquid supply channel 7 and the waste liquid discharge channel 8 are closed again. As a result, the filling liquid 52 is tightly confined or sealed within the cleaning liquid supply channel 7 and the waste liquid discharge channel 8 (step S103).

After that, the trigger valve 9 is slid upward (in the direction shown by arrows Q1 in FIG. 3B), so that the outlet opening portion of the paint supply channel 3 is opened, and the valve body 14 of the supply portion 11 is pushed upward by the trigger valve 9 to open the penetration hole 11*b* of the supply portion 11. That is, the paint supply channel 3 and the supply portion 11 are linked in communication via the space 2*a* formed within the support portion 2 (step S104).

After the communication between the paint supply channel 3 and the supply portion 11 is provided, the paint 51 is supplied into the supply portion 11 via the paint supply channel 3, so that the paint 51 is supplied into the paint cartridge 10 (step S105). That is, after the cleaning liquid supply channel 7 and the waste liquid discharge channel 8 that constitute the branch channel 6 are filled with the filling liquid 52, the trigger valve 9 opens the outlet opening portion of the paint supply channel 3, so that the paint 51 is supplied into the paint cartridge 10 via the paint supply channel 3.

At this time, since the cleaning liquid supply channel 7 and the waste liquid discharge channel 8 are filled with the filling liquid 52 as shown in FIG. 3C, it does not happen that a part of the paint 51 flowing in the paint supply channel 3 flows out of the increased-diameter portion 4*a* into the cleaning liquid supply channel 7 or the waste liquid discharge channel 8, that is, the paint 51 flowing in the paint supply channel 3 is supplied entirely into the supply portion 11.

Figure 4B:
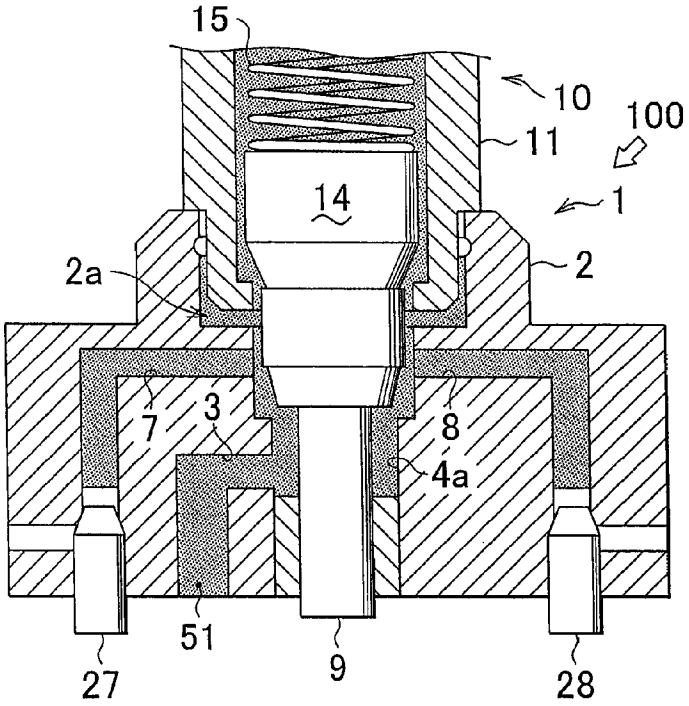
FIGS. 4A and 4B show an operation that a filling valve of a comparative example performs when filling a paint into a paint cartridge, and, specifically.
Figure 4A:
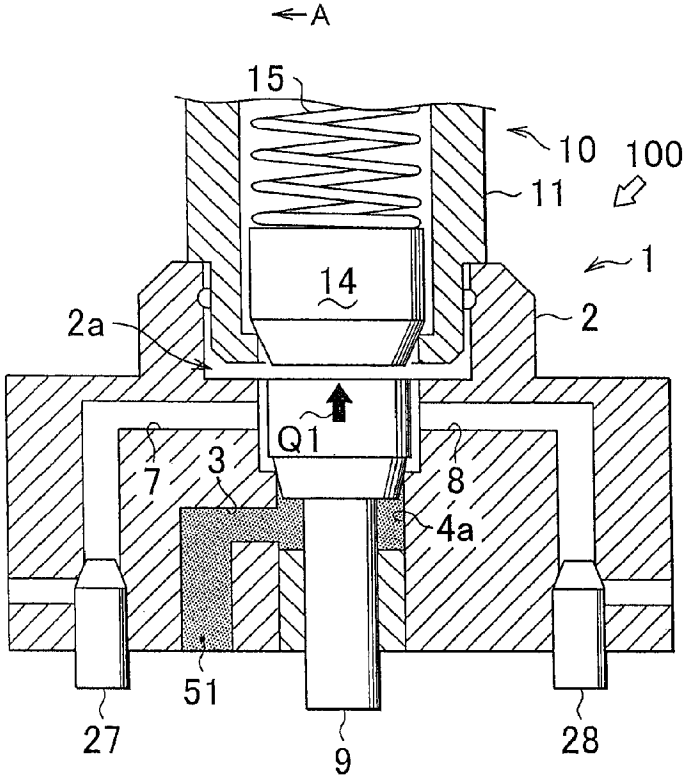

That is, according to the comparative example, the paint supply method for the paint cartridge 10 is performed as shown in FIGS. 4A and 4B. That is, the filling liquid 52 (see FIGS. 3A to 3C) is not filled into the cleaning liquid supply channel 7 or the waste liquid discharge channel 8 before the paint 51 flows in the paint supply channel 3 (see FIG. 4A). Instead, after the paint cartridge 10 is attached to the filling valve 1, the trigger valve 9 is immediately actuated to send the paint into the supply portion 11.

As a result, as shown in FIG. 4B, a part of the paint 51 that has reached the increased-diameter portion 4*a* of the paint supply channel 3 flows out into the cleaning liquid supply channel 7 or the waste liquid discharge channel 8, so that the paint 51 compresses the air remaining within the two supply channels 7 and 8, and therefore the paint 51 is filled into substantially the entire region in the two supply channels 7 and 8.

The paint 51 filled into the cleaning liquid supply channel 7 and the waste liquid discharge channel 8 is not sent into the paint cartridge 10 again, but is handled as a paint loss. However, according to the paint supply method in this embodiment, such a paint loss can be eliminated, which is economically advantageous.

Incidentally, in the filling liquid 52 in accordance with the embodiment, in order to certainly reduce the outflow of the paint 51 into the cleaning liquid supply channel 7 or the waste liquid discharge channel 8, it is necessary to use a non-compressible liquid. It is conceivable to use, for example, a thinner that is often used as a cleaning liquid. However, the filling liquid 52 used herein is preferably pure water.

That is, when the paint 51 is supplied into the supply portion 11 of the paint cartridge 10, the filling liquid 52 that is filled in the gap between the increased-diameter portion 4*a* of the paint supply channel 3 and the valve body 9*a* of the trigger valve 9, the space 2*a* between the bottom surface of the inside diameter portion of the support portion 2 and the lower end surface of the supply portion 11, etc., which is small in amount, becomes mixed with the paint 51. Therefore, considering that the paint 51 in this embodiment is a water base paint that is employed in the electrostatic painting, it is preferable that the filling liquid 52 be pure water.

After the supply of paint into the paint cartridge 10 is completed, the trigger valve 9 is slid downward (in the direction shown by an arrow Q2 in FIG. 3C) so that the outlet opening portion of the paint supply channel 3 is closed and the valve body 14 of the supply portion 11 is pushed downward by the urging means 15. Thus, penetration hole 11*b* of the supply portion 11 is closed. That is, the state of linkage in communication between the paint supply channel 3 and the supply portion 11 is discontinued (step S106).

After that, the cleaning valve 27 and the waste liquid valve 28 are moved to open the cleaning liquid supply channel 7 and the waste liquid discharge channel 8, respectively. Thus, the cleaning liquid is supplied via the front end portion of the cleaning liquid supply channel 7. The supplied cleaning liquid reaches the increased-diameter portion 4*a* of the paint supply channel 3, and is further sent into the waste liquid discharge channel 8, and is discharged to the outside of the filling valve 1. Thus, the cleaning liquid extrudes the filling liquid 52 to the outside of the filling valve 1, and also washes off the paint adhering to the site of linkage in communication between the paint supply channel 3 and the supply portion 11, that is, the upper end portion of the trigger valve 9, the lower end portion of the supply portion 11, the inside diameter portion of the support portion 2, etc.

Then, after a predetermined amount of the cleaning liquid is supplied into the cleaning liquid supply channel 7, the compressed air is pumped into the cleaning liquid supply channel 7, so that the cleaning liquid remaining in the cleaning liquid supply channel 7 and the waste liquid discharge channel 8 and the like the cleaning liquid as a post-cleaning waste liquid) is discharged to the outside of the filling valve 1.

Thus, by supplying the cleaning liquid into the cleaning liquid supply channel 7 and pumping the compressed air thereinto, the cleaning operation with respect to the upper end portion of the trigger valve 9, the lower end portion of the supply portion 11, etc., is executed (step S107).

After the cleaning operation is completed, the paint cartridge 10 is detached from the filling valve 1 (step S108), and another paint cartridge 10 that has become empty is attached to the filling valve 1.

As described above, the paint supply method in this embodiment is a paint supply method of supplying a paint into the paint cartridge 10 by using a filling valve 1 that has: a paint supply channel 3 that is linkable in communication with a supply portion 11 provided for supplying the paint into the paint cartridge 10; a branch channel 6 that branches from the paint supply channel 3 near a site of linkage in communication between the supply portion 11 and the paint supply channel 3; and a trigger valve 9 as an open-close valve of the paint supply channel 3 which is disposed in the paint supply channel 3 upstream of the site of linkage in communication, the method including the steps of: opening the trigger valve (open-close valve) 9 after filling a filling liquid 52 into the branch channel 6; and then supplying the paint into the paint cartridge 10 via the paint supply channel 3.

In this embodiment, the use of the foregoing paint supply method makes it possible to economically and certainly reduce the paint loss that occurs when the paint 51 is supplied into the paint cartridge 10, without requiring the provision of a mechanical shutting-off mechanism or the like.

That is, the paint loss occurs as a part of the paint 51 flows out into the branch channel 6 when the paint 51 is supplied into the paint cartridge 10 via the paint supply channel 3. In this embodiment, without providing a mechanical shutting-off mechanism or the like, a process of filling the filling liquid 52 into the branch channel 6 prior to supplying the paint 51 into the paint cartridge 10 is performed.

Thus, by performing the process of filling the filling liquid. 52 into the branch channel 6, which can be executed at relatively low cost, it is possible to prevent the outflow of the paint 51 into the branch channel 6 and therefore reduce the paint loss.

Besides, in the paint supply method in this embodiment, the branch channel 6 is constructed of the cleaning liquid supply channel 7 that supplies the cleaning liquid for cleaning the foregoing site of linkage in communication and also supplies the compressed air for discharging the post-cleaning waste liquid, and the waste liquid discharge channel 8 that discharges the post-cleaning waste liquid from the site of linkage in communication and the compressed air to the outside of the branch channel 6, and the filling liquid 52 is supplied via the cleaning liquid supply channel 7.

Thus, in the paint supply method in this embodiment, the filling liquid 52 that is filled into the cleaning liquid supply channel 7 and the waste liquid discharge channel 8 is supplied by the cleaning liquid supply channel 7. Without a need to separately provide a supply channel for the filling liquid 52 or the like, the paint supply method economically reduces the paint loss that occurs at the time of supplying the paint 51 into the paint cartridge 10.

Besides, in the paint supply method in the embodiment, the cleaning liquid supply channel 7 and the waste liquid discharge channel 8 are provided with open-close valves that open and close intermediate portions of the channels 7 and 8, that is, the cleaning valve 27 and the waste liquid valve 28, respectively. After the cleaning liquid supply channel 7 and the waste liquid discharge channel 8 are filled with the filling liquid 52, the cleaning valve 27 and the waste liquid valve 28 are closed to tightly confine the filling liquid 52 within the cleaning liquid supply channel 7 and the waste liquid discharge channel 8 (step S103). After the filling liquid 52 is tightly confined, the paint is supplied into the paint cartridge 10 via the paint supply channel 3 (step S105).

Due to the use of the foregoing paint supply method, this embodiment is able to certainly reduce the paint loss that occurs at the time of supplying the paint 51 into the paint cartridge 10. That is, the supply of the paint 51 into the paint cartridge 10 is executed after the filling liquid 52 sent into the cleaning liquid supply channel 7 and the waste liquid discharge channel 8 has been certainly confined therein tightly by the cleaning valve 27 and the waste liquid valve 28 that are provided in the two channels 7 and 8, respectively.

Therefore, when the paint 51 flows in the paint supply channel 3, the filling liquid 52 that fills the cleaning liquid supply channel 7 and the waste liquid discharge channel 8 does not leak out; therefore, it is possible to certainly prevent outflow of part of the paint 51 into either one of the two channels 7 and 8.

Besides, in the paint supply method in the embodiment, the filling liquid 52 is pure water.

Due to the use of the filling liquid 52 having such a property, the embodiment is able to certainly reduce the paint loss that occurs at the time of supplying the paint 51 into the paint cartridge 10, without adversely affecting the paint 51 that is supplied into the paint cartridge 10.

That is, since the paint 51 used in the embodiment is a water base paint that is employed in the electrostatic painting, the filling liquid 52 that is pure water will not adversely affect the paint 51 by chemical reaction or the like if the paint 51 should be contaminated with a small amount of the filling liquid 52 when the paint 51 is supplied into the paint cartridge 10.

The invention claimed is:

1. A paint supply method of supplying a paint into a paint cartridge, comprising:

attaching the paint cartridge to a filling valve, wherein the filling valve includes:

a paint supply channel that is linkable in communication with a supply portion of the paint cartridge and that is provided for supplying the paint into the paint cartridge, a branch channel that intersects the paint supply channel at a site of linkage in communication between the supply portion of the paint cartridge and the paint supply channel, wherein the branch channel is constructed of a cleaning liquid supply channel that supplies a cleaning liquid for cleaning the site of linkage in communication and supplies a compressed air for discharging a post-cleaning waste liquid, and a waste liquid discharge channel that discharges the post-cleaning waste liquid from the site of linkage in communication and discharges the compressed air to an outside of the branch channel, the cleaning liquid supply channel and the waste liquid discharge channel being provided with open-close valves that open and close an intermediate portion of the cleaning liquid supply channel and an intermediate portion of the waste liquid discharge channel, respectively, wherein the cleaning liquid supply channel intersects a first side of the paint supply channel, and the waste liquid discharge channel interests a second, and opposite, side of the paint supply channel so that the cleaning liquid, the post-cleaning waste liquid, and the compressed air can flow across the paint supply channel from the first side to the second side of the paint supply channel, and an open-close valve of the paint supply channel which is disposed in the paint supply channel upstream of the site of linkage in communication;

opening the open-close valves of the cleaning liquid supply channel and the waste liquid discharge channel;

filling the branch channel with a filling liquid;

after the branch channel is filled with the filling liquid, confining the filling liquid within the branch channel by closing the open-close valves of the cleaning liquid supply channel and the waste liquid discharge channel;

after the filling liquid is confined, opening the open-close valve of the paint supply channel; and supplying the paint into the paint cartridge via the paint supply channel while the filling liquid is confined.

2. The paint supply method according to claim 1, wherein the filling liquid is pure water.

3. The paint supply method according to claim 2, wherein the paint is a water base paint that is usable in electrostatic painting.

* * * * *